US005634438A

United States Patent [19]

Wilson

[11] Patent Number: 5,634,438

[45] Date of Patent: Jun. 3, 1997

[54] LARGE ANIMAL STOCK

[76] Inventor: Eugene S. Wilson, 18275 Alta Way, Cottonwood, Calif. 96022

[21] Appl. No.: 366,229

[22] Filed: Dec. 28, 1994

[51] Int. Cl.[6] ..... A61D 3/00

[52] U.S. Cl. ..... 119/752

[58] Field of Search ..... 119/732, 751, 119/752, 756

[56] References Cited

U.S. PATENT DOCUMENTS

| | | | |
|---|---|---|---|
| 2,957,451 | 10/1960 | Brockman | 119/751 |
| 4,201,158 | 5/1980 | Parker | 119/751 |
| 4,432,305 | 2/1984 | Vernese | 119/752 |
| 4,470,372 | 9/1984 | Norman | 119/751 X |

*Primary Examiner*—Thomas Price

*Attorney, Agent, or Firm*—Mark C. Jacobs

[57] ABSTRACT

A large animal stock formed of two spaced side frames transversely connected at the front and rear to form an enclosure. Each side frame features an elevated top member both of which may be transversely connected along the length of the side frame at an elevation high enough not to impede access and egress of the animal to be confined within the stall.

One or both side frames includes at least one outwardly pivotal guide bar, designated a gate arm, to help ease the animal into stock from the side. Adjustable bar(s) connected between the side frames may be relocated to diminish the confinement area of the animal for the ease and convenience of the handler. A quick release chain securing mechanism for attaching a chain to the animal's halter is also provided.

30 Claims, 7 Drawing Sheets

FIG. 8
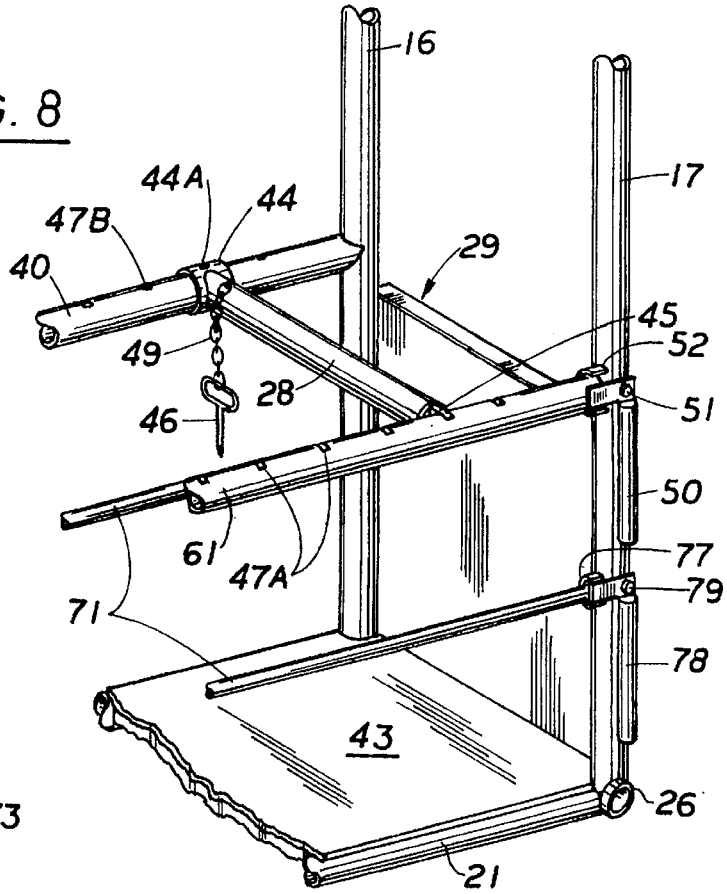
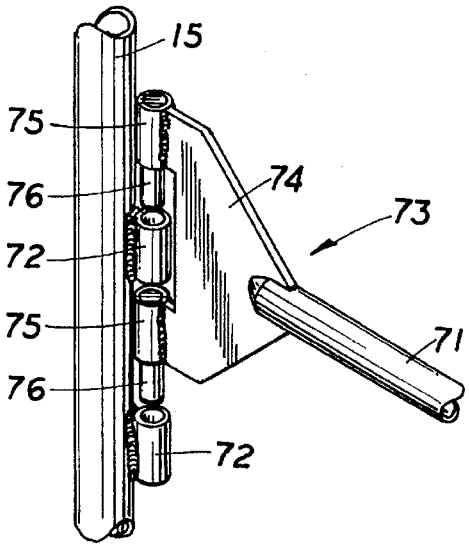
FIG. 9
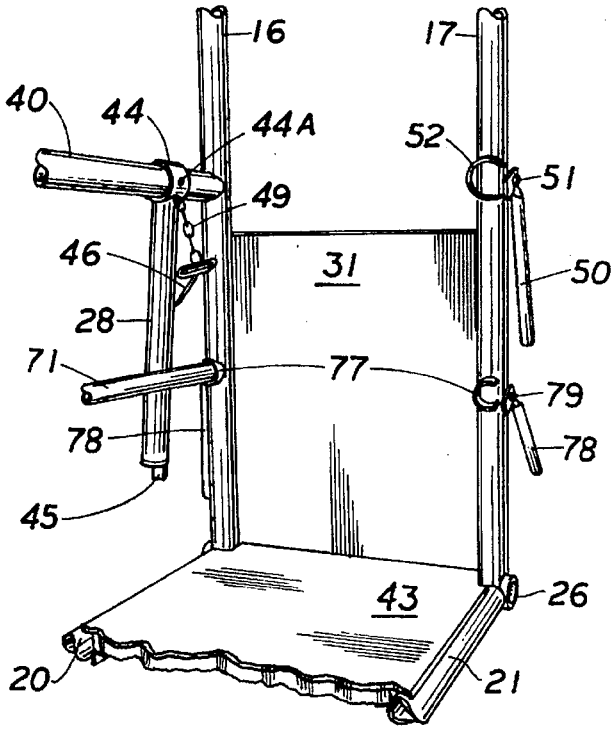
FIG. 10

LARGE ANIMAL STOCK

FIELD OF THE INVENTION

Background of the Invention

This application relates to an improved large animal stock which is an apparatus for confining and retaining farm animals such as horses, donkeys and mules for effectively immobilizing the animal for the operator to carry out one or more of the processes of washing, treating, worming, palpating, et cetera. Stalls that are used for milking cows do not find favor among veterinarians and others who must treat horses and other large animals. This is because extra components needed for the milking chore get in the way of the veterinarian or other attendant.

While stocks do exist in the prior art for horses, and other large animals, none of the stocks known to applicant are adjustable in size to accommodate animals as small as quarter horses and up to "full" size draft horses. In addition, none of the known stocks provide means of easy access to the stock for the animal combined with easy access to the animal for the handled.

There is a need therefore for a large animal stock which is readily accessible to the animal without spooking the animal and which permits easy access to the animal by the veterinarian or other handler.

It is an object of this invention to provide an easy access stock for large animals.

It is another object to provide a stock that permits direct unimpeded access to the animal to be treated.

It is yet another object to provide a stock wherein the usable length can be readily adjusted to prevent the animal therein from rotating or moving rearwardly therein.

It is a still further object to provide a stock that can be transported in the bed of a pickup truck.

Other objects of the invention will in part be obvious and will in part appear hereinafter.

Applicant caused a patent novelty search to be run, and as a result of that search, the following patents turned up:

1,928,819 Neller
2,483,516 Babson
2,528,255 Thomas
3,415,227 Welsh
4,070,989 Ganzel
4,129,096 Nickel
4,244,324 Kratky
4,470,372 Norman
4,552,094 Johnson
4,590,886 Brashear None of these references either taken alone or in combination, disclose the large animal stall of this invention.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

BRIEF DESCRIPTION OF THE FIGURES

FIG. 8 is a close-up perspective view illustrating the operation of the rear cross arm forming a part of this invention.

FIG. 9 is a close-up diagrammatic view of a hinge employed in this invention.

FIG. 10 is a right perspective view of the rear interior of this apparatus.

SUMMARY OF THE INVENTION

A large animal stock formed of two spaced side frame transversely connected near the front and at the rear to form an enclosure. Each side frame features an elevated top member both of which may be transversely connected along the length of the side frame at an elevation high enough not to impede access and egress of the animal to be confined within the stall.

One or both side frames includes an outwardly pivotal guide bar to help ease the animal into stock from the side. The apparatus also features at least one transverse laterally adjustable bar connected between the side frames which may be relocated to diminish the confinement area of the animal for the ease and convenience of the handler.

A quick release chain retention means for holding a chain connected to an animal's halter is also provided.

DESCRIPTION OF THE PREFERRED EMBODIMENT

Figure 1:
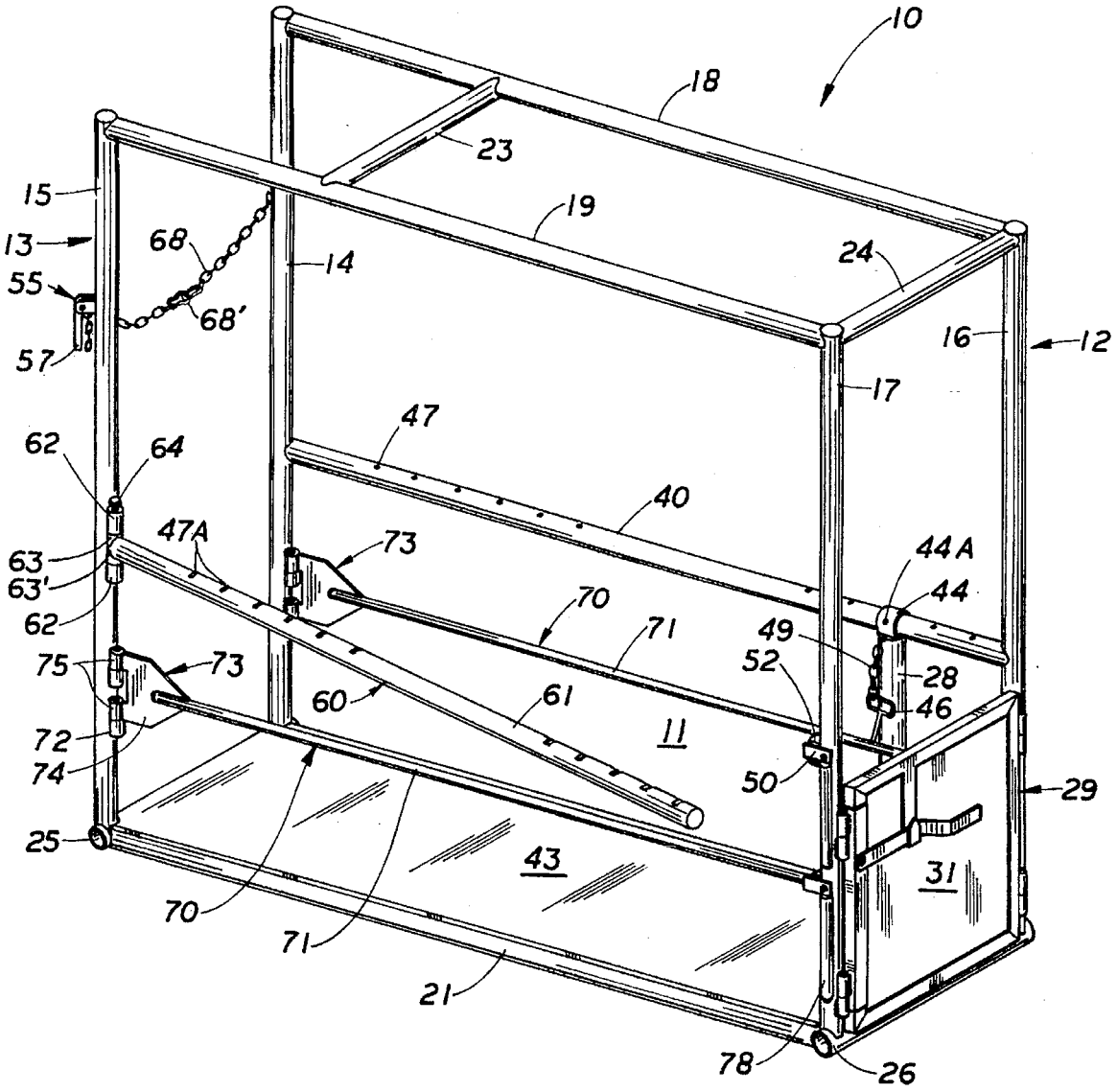
FIG. 1 is a right rear perspective view of the apparatus of this invention.

Reference is now made to FIG. 1 where it is seen that the portable stock 10 of this invention is formed from a plurality of interconnected components. The first of these includes a pair of spaced opposite side frames, 12 being the left frame and 13 being the right frame. See also FIG. 3. These two side frames 12 and 13 are connected together by a series of transversely disposed spatially separated members.

Figure 3:
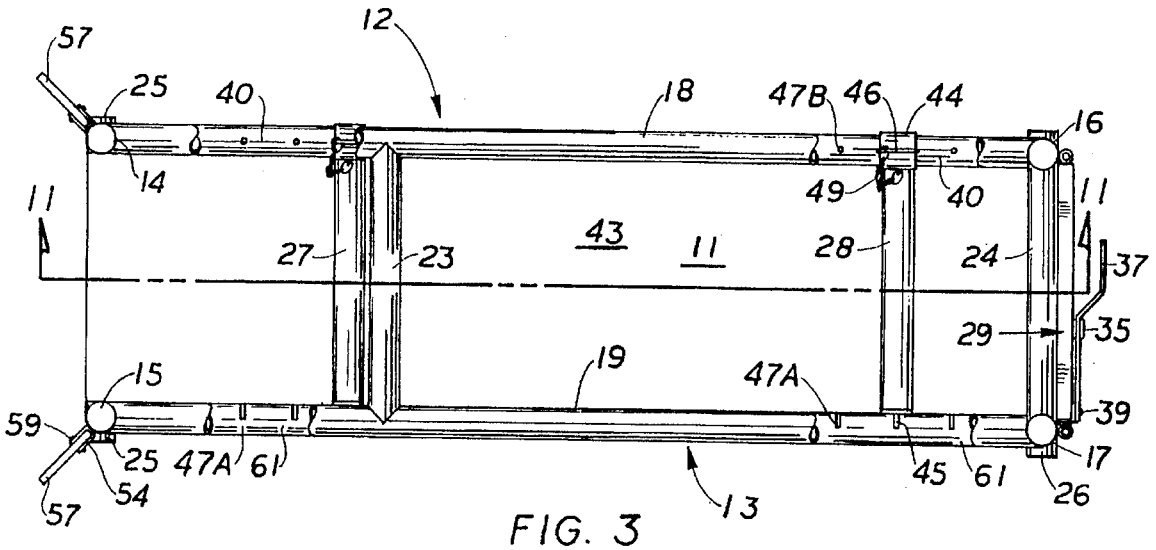
FIG. 3 is a top plan view thereof.

Thus, as seen in FIG. 3 the frames 12 and 13 are connected at the top by a forwardly directed intermediate member 23 and rear top member 24. Whereas the length of each of the frame members is slightly under 9', the spacing of the intermediate top across member 23 is preferably set at about 2' from the front rather than in the middle or at the front to provide both frontal stability for the apparatus, while avoiding possible injury to a horse should it rear up after loading.

Figure 2:
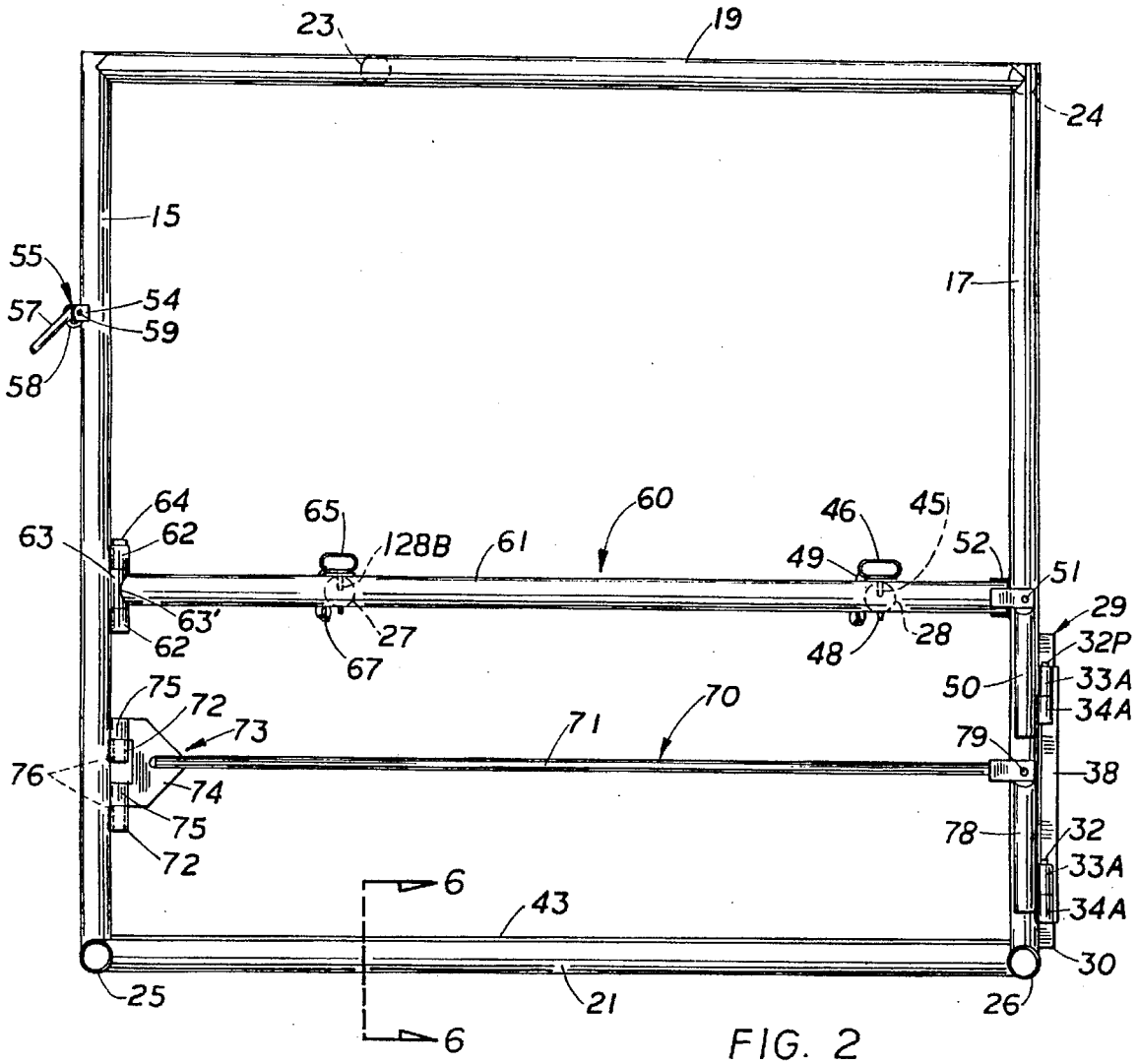
FIG. 2 is a right side elevational view thereof.

The frames 12 and 13 are also connected, as seen in FIG. 2, by the front and rear bottom cross members 25 and 26, respectively. Together, these members define a space 11 within the stock for confining a horse or other animal. Note that in FIG. 1 only one cross bar, here 28 is shown. The use of two such crossbars is preferred and the discussion of FIG. 15 pertains to such a front bar, 27, with 28 being the rear bar. Top view FIG. 3 illustrates the use of both bars 27 and 28. Also seen in FIG. 3 are the individual slots 47A for the receipt of finger 128B per FIG. 15, and the individual bores 47B for the receipt of pin 65 also shown in FIG. 15.

It should be recognized that FIG. 2 is a right side elevational view of this invention. The left side elevational view, is substantially similar to FIG. 2 but for the deletion of the two latch arms 50 and 78 and their pivot pins 51 and 79, respectively. Other minor differences will be pointed out during the course of the discussion.

Each of the right and left side frames is comprised of similar tubing members which will be described forthwith. Thus, as seen in FIG. 2 the right frame is formed from right front vertical member 15 which is spaced from right rear vertical member 17 and is connected thereto to by top right horizontal member 19 and bottom right horizontal member 21. Note should be taken that whereas frame member 19 is directly welded or otherwise secured to front and rear vertical members 15 and 17, the bottom member 21 is connected to the front and rear bottom cross members 25 and 26, respectively. See FIGS. 2, 4 and 5.

Figure 5:
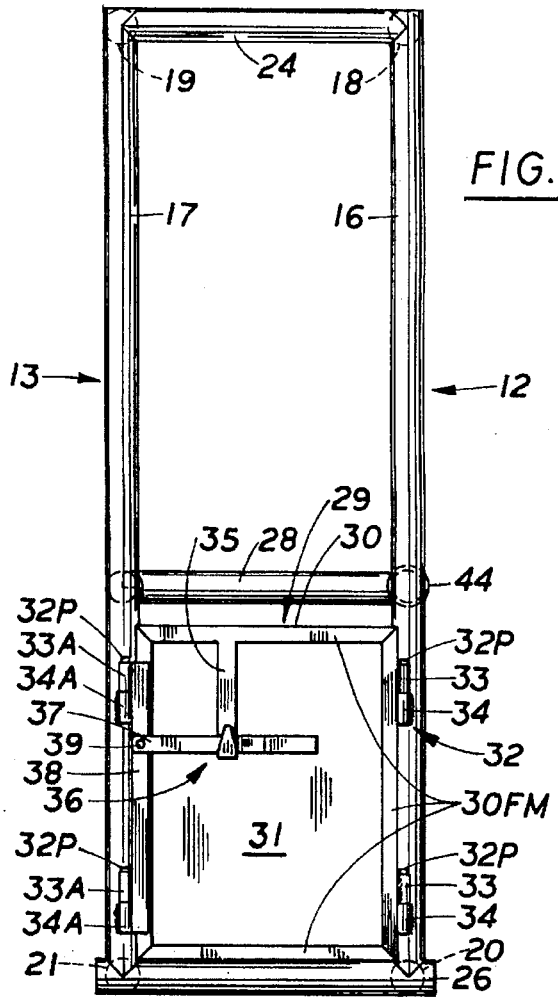
FIG. 5 is a rear elevation view thereof.

The corresponding left frame is formed from left front vertical member 14, (see FIG. 11) which is connected as by welding or other means to top left horizontal member 18 and bottom left horizontal member 20. The left rear member 16 seen in FIG. 5 is connected at the opposite end of top left member 18 and bottom left member 20. As pointed out previously, it is again noted that middle top cross member 23 is positioned preferably forwardly of the middle of said side frame, and it interconnects right and left top members 18 and 19 as per FIG. 3. All of the frame members previously discussed may be formed preferably of steel and welded together. It is believed that other metallic piping could be employed. The tubing employed may range in cross section preferably from 2 to 4-inches, though larger size tubing may also be employed.

Figure 4:
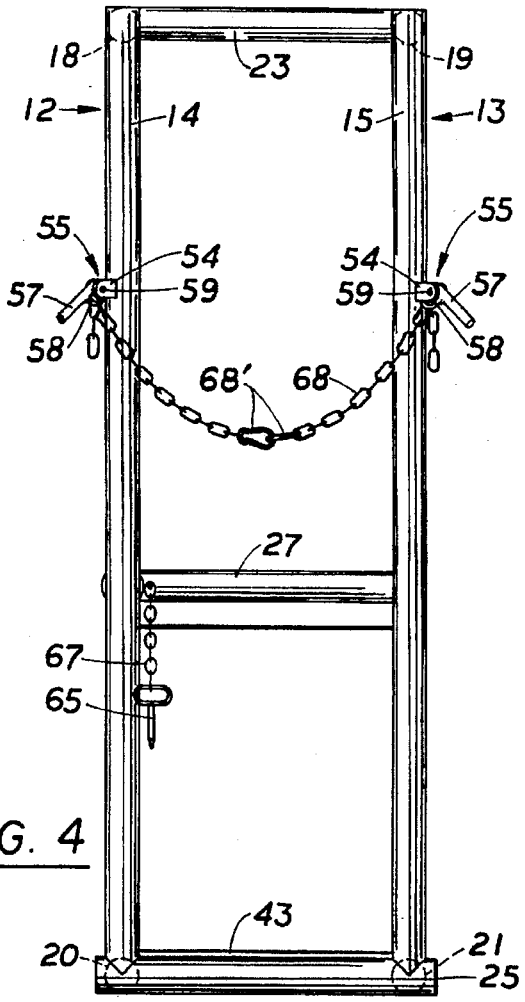
FIG. 4 is a front elevational view of this stock of this invention.
Figure 14:
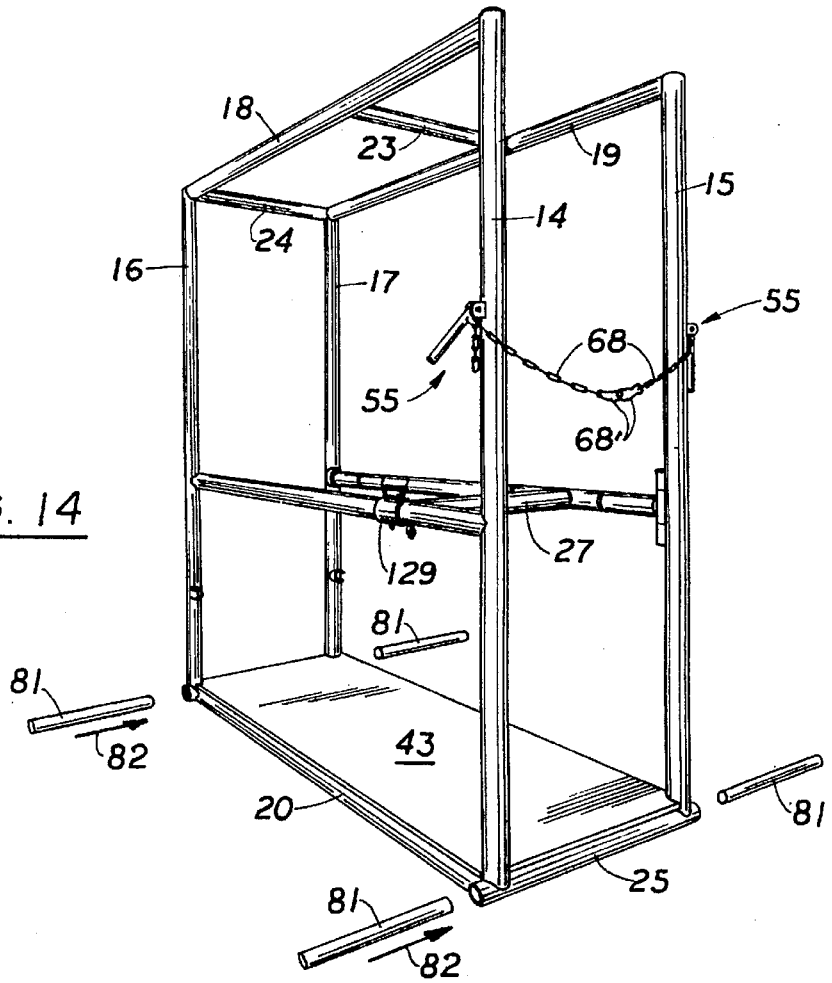
FIG. 14 is a left front perspective view of the apparatus of this invention which illustrates a variant in the construction of the front of the apparatus and in particular the front crossbar with respect to its disposition and operation.
Figure 15:
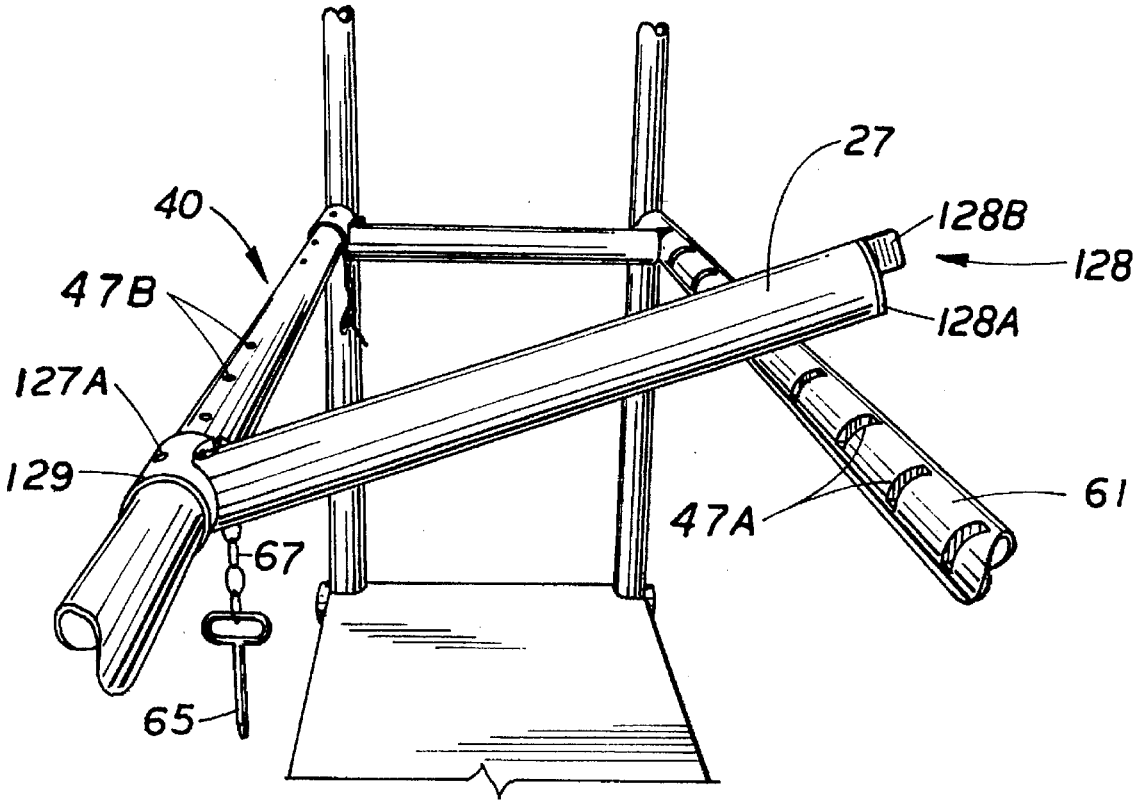
FIG. 15 is a close-up perspective view of the crossbar prior to insertion.

Reference should now be made to FIG. 4 wherein it is seen that there are two front vertical frame members 14 and 15. A front cross bar 27, is disposed between arms 40 and 61. See FIGS. 2, 3 and 15. This crossbar 27 is disposed BEHIND the front members 14 and 15 as seen in FIG. 14 and FIG. 15. The utilization and positioning of crossbar 27 is discussed with reference to FIG. 15. This is done to temporarily restrain the animal confined within space 11 such that it does not exit out of the front of the apparatus 10.

As seen in FIG. 15, crossbar 127 is seen to be a preferably tubular member in cross section. At one end, preferably the left end as viewed from the front of the apparatus, attached thereto is a collar 129, disposed normal to the length of the crossbar. This collar is sized in cross section slightly larger than the connector bar 40, which it encircles, such that the crossbar with the collar can move freely along the length of the connector bar. This front cross bar 27 includes at the opposite, and preferably its right end 128, a projecting finger member 128B. The bar 27 may include an optional closure cap designated 128A, for the open end of the crossbar to prevent the internal accumulation of moisture in the tube. The forwardly projecting finger 128B, is welded or otherwise attached vertically across the diameter of the crossbar 27 if the cap is not used; and or the finger is welded in an upstanding position on the cap 128A if so employed. The lock pin, 65 would be disposed into suitable bores, 47B, in said connector bar, here 40.

In FIG. 8, the rear cross bar 28 has mounted at one extreme a collar 44 which encircles connecting bar 40. The other end of the rear cross bar 28 has a finger 45 thereon, similar to the finger of bar 27 for disposition in aligned slots 47A. This finger 45 is similar to finger 128B shown in FIG. 15. Collar 44 is sized in diameter such that it can be freely moved along the length of the connector bar upon which it rides. While in FIGS. 5 and 8 the collar 44 is shown to be on the left gate arm, it can just as easily be disposed upon the right gate arm.

Because the collar 44 is sized to fit over connector bar 40, the rear cross bar 28 can be adjusted forwardly as desired to reduce the area within space 11 for the animal to move around. To secure cross bar 28 at the desired location, a series of individual spaced slots 47A, are provided in gate arm 61 for finger 45. And, a series of spaced bores are provided in connector bar 40—see FIGS. 3 & 8—to receive lock pin 46 which can engage one of said bores 47B in alignment with a respective slot. Collar 44 includes a single bore 44A which will vertically align with the chosen bore 47B for receipt of lock pin 46 which in turn is retained in place on the collar by chain 49.

Reference is also made to FIG. 2, wherein the finger 45 is shown disposed in slot 47A. This feature has been and will be discussed further supra.

Figure 12:
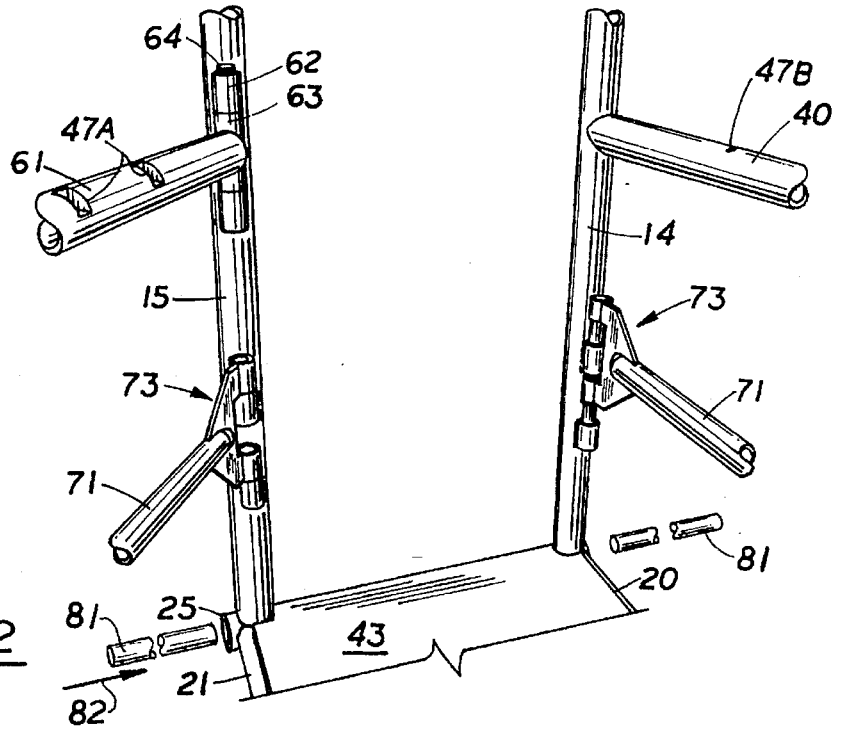
FIG. 12 is a front interior perspective view of the apparatus of this invention.

The reader's attention is called to the fact that while the tubular members in the drawings are seen to be circular in cross section, there is no reason why square tubing cannot be utilized instead between the respective collars and fingers. By providing a series of spaced apertures 47A along the top rear surface of gate arm 61 such that the rear cross bar 28, can be disposed at varying locations along it, the proper placement of the rear bar 28 can be beneficial for aiding in the confinement of smaller horses such as quarter horses for example. Reference is also made to FIG. 12, wherein one of a series of bores 47B in connector bar 40 is shown in transverse alignment with the one of a series of similarly spaced slots 47A in gate arm 61.

These aligned series of bores and slots permit the user to pin both the front cross bar 27 and the rear cross bar 28 at several different locations using pins 46 and 65 respectively. Reference is also made to FIG. 1 wherein collar 44 may be seen with the rear cross bar 28 attached thereto and disposed in a generally vertical position due to gravity.

Also shown in FIG. 12 are two of the four outrigger bars 81 used at each corner of the apparatus 10. See also FIG. 14 which shows placement of three of the outriggers. An arrow 82 points to the receiving opening in the respective bottom members wherein such outriggers are disposed. These outriggers may be made of 2.0 to 2.5" tubular members, whereas the bottom members may be of 3" tubing. The outriggers since sized in cross section slightly smaller than the tube that receives them, are easily inserted a distance of a foot or so and provide a stabilizing effect when the apparatus is to be utilized. To minimize the trailer size for carrying the apparatus, the outriggers are removed for storage during transit.

Figure 7:
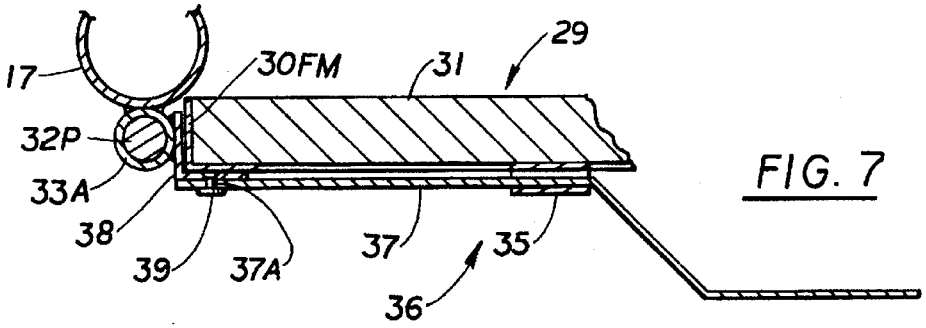
FIG. 7 is a close-up diagrammatic view of the rear door latching mechanism forming a part of this invention.

Reference is now again made to FIG. 5 for the discussion concerning the rear and more particularly door 29. Door 29 is comprised of a panel 31 set into a door frame 30 in the same manner as a picture would be laid into a picture frame. The frame 30 is formed of generally L-shaped framed members each of which is designated 30FM and each of which has a miter corner on each end such that when the four frame members are put together, normal to each other, a total frame 30 is formed. The frame 30 can be secured to the door panel 31 by suitable screws or by an adhesive. Since the door panel 31 is preferably wood it is within the skill of the art to attach the panel to the frame with screws. The screw apertures through the frame members are not shown here. One of the vertical frame members 30FM, here the right side as seen from the rear (i.e., the left side as viewed from the front) includes a hinge portion 33 attached to it while a mating hinge portion 34 is secured as by welding to left rear member 16 both at the upper end and the lower end of the door. When these are interconnected by a hinge pin 32P a hinge 32 is formed. A J-shaped latch holder 35 is secured to panel 31 and optionally to top frame member 30FM for the receipt of latch handle 37 which in turn forms an element of latch means 36 to be described next. Reference is also made to the top view, FIG. 7 which shows the latch handle 37 disposed within the J-shaped latch holder 35.

Latch means 36 comprises hinge portions 34A which is welded to a vertical frame member, here the right vertical member 17 when one views FIG. 5. L-bracket 38 is mounted to hinge member 33A as by welding or other suitable means. Hinge pin 32P is inserted to connect the two hinge halves 33A and 34A in rotatable alignment. To open the rear door latch means 36 is raised out of latch holder 35, the latch means is swung outwardly to allow door 29 to also be swung open outwardly. Latch handle 37 is pivotally mounted to the surface of the L-bracket 38 by pivot pin 39 which passes through a suitable aperture 37A in said latch handle 37.

Figure 6:
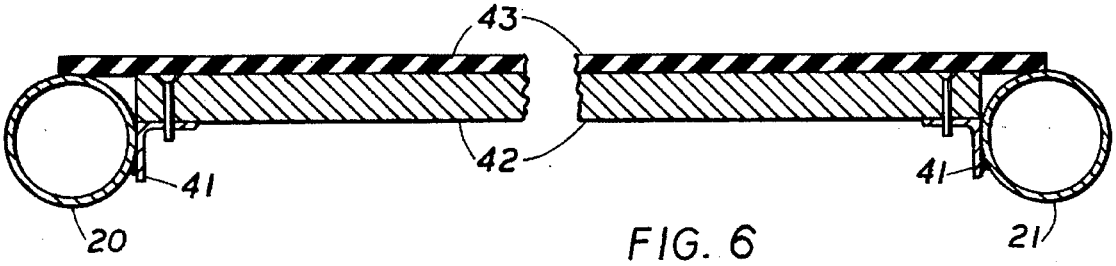
FIG. 6 is a sectional view taken along the line 6—6 of FIG. 2.

The discussion moves now to FIG. 6 for a description of the floor of the stock of this invention. The bottom left and bottom right members 20 and 21 respectively are each seen to have an inverted L-shaped elongated flange attached thereto along the length thereof. The L-flanges 41 are directed inwardly toward each other. A support, i.e., subfloor 42 which may be of 1⅛th inch plywood or other suitable wood or substrate sections rests upon the two L-flanges between the two frame members 20, 21. A rubber mat or other nonslip surface 43 rests on top of the support 42 as well as upon the two tubes 20 and 21 in view of the fact that the width of said traction mat 43 is greater than that of the support 42. Traction mat 43 may optionally be adhered to the support 42 if desired. Typically the inverted L-flange may be formed from ⅛th-inch thick 1½×1½-inch angle iron suitably welded to members 20 and 21.

The discussion now turns to the upper gate arm mechanism 60 which is depicted in FIGS. 1, 2 and 8. The upper gate arm mechanism 60 includes the upper gate arm 61, which is in turn welded to a hinge section 63. A pair of gate hinge tubes 62 are spaced and welded or otherwise attached to right front member 15 as noted in FIG. 2. The spacing is set to slightly exceed the elevation of hinge section 63. The lower of the two gate hinge tubes 62 may be closed off at the bottom as by a small weld to help retain hinge pin 64, shown in FIG. 2, from passing through the lower of the two gate tubes or pin 64 could have an enlarged head section to preclude downward slippage.

Gate arm 61 is preferably formed of 1-inch schedule 40 pipe and the hinge section bushing 63 may be formed of 1.25-inch diameter schedule 40 pipe. Each of the two gate hinge tubes 62 are formed of the same material as the hinge section 63.

In FIG. 2 the respective fingers of the cross bars 27 and 28 are shown disposed within spaced slots 47A but seen from a different vantage point such that the slots themselves can not be seen.

Reference is now returned to FIG. 8 wherein the unattached end of gate arm 61 is seen. This arm 61 which can pivot as previously discussed when at rest is disposed within C-collar 52 which is welded or otherwise attached to right rear vertical member 17. The cross section of C-collar 52 is slightly larger than that of gate arm 61 such that passage in and out can take place quite easily. Retention within this C-collar which has it's open side facing exteriorly of space 11 is provided by swing gate latch 50. Swing gate latch 50 is pivotally secured to said member 17 by pivot pin 51. See also FIG. 2 which shows gate arm 61 in it's retained position, whereas in FIG. 1 it is shown swung free from its locked position.

Figure 11:
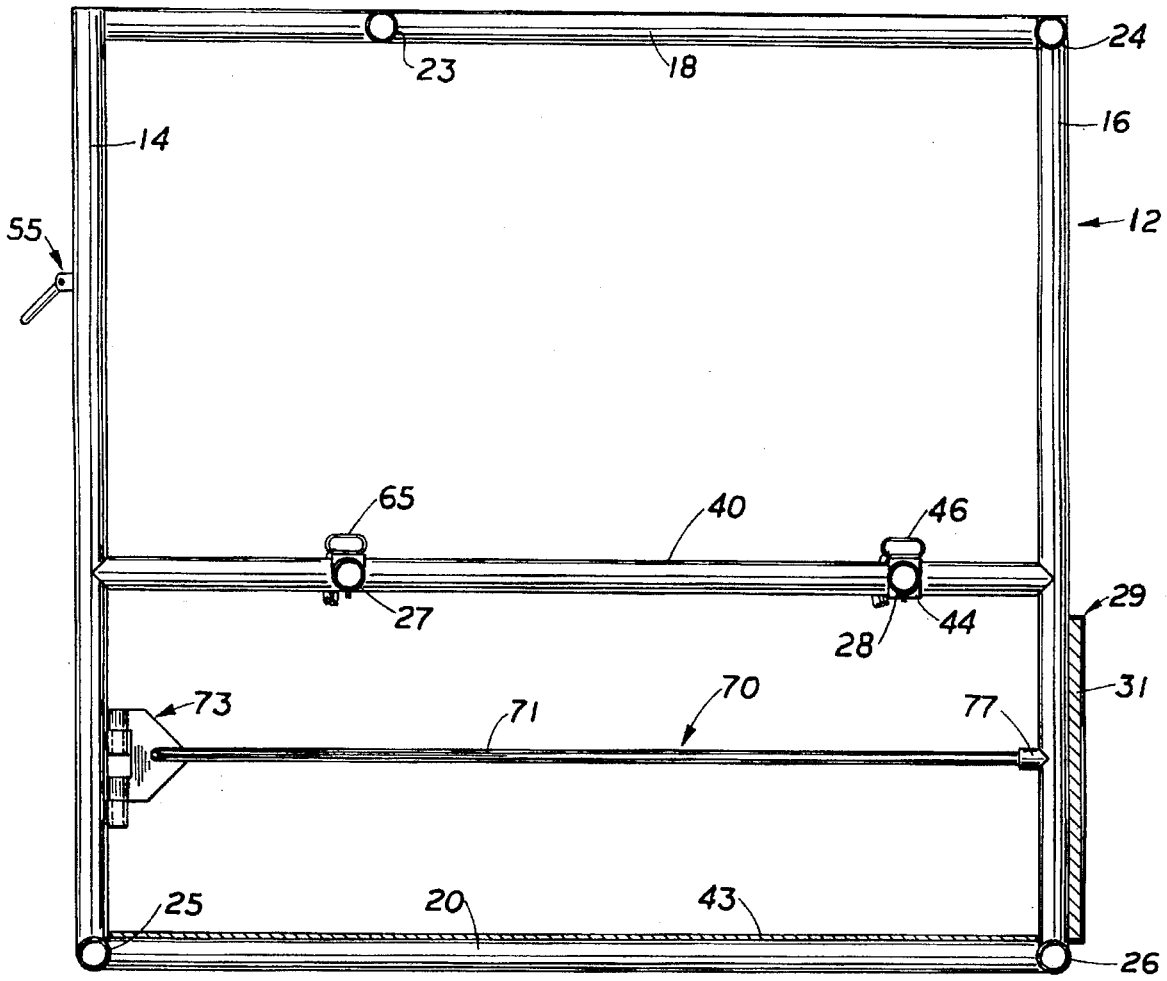
FIG. 11 is a sectional view of the interior left side of this apparatus taken along line 11—11 of FIG. 3.

In the left side drawing FIG. 11, connector bar 40 is seen to be directly welded to left front vertical member 14 and left rear vertical member 16 such that connector bar 40 obtains a disposition parallel to the ground.

In a variant embodiment of this invention, the left frame would have as its intermediate member, a swing arm mechanism 60, as well as would the right frame. Obviously, the connector bar 40 could be placed on the right side of the structure rather than on the left side of the structure as is being discussed here should that be to the ease and convenience of the operator who perhaps may be a left-handed person or for logistic reasons.

The discussion to follow relates to the lower gate mechanism arm 70 as seen in FIG. 1, 2 and 11 among others. Whereas upper gate arm mechanism 60 is intended to be pivotally mounted but permanently affixed, lower gate arm mechanism 70 is pivotally mounted and removable. This mechanism includes an elongated lower gate arm 71 welded or otherwise secured to hinge 73 which comprises hinge plate 74 which is generally triangular in shape and which has welded at opposite ends of its base a pair of aligned spaced hinge tubes 75. See also FIG. 9. Depending downwardly from each of these hinge tubes 75 which may be of 1¼-inch diameter schedule 40 pipe is a 1-inch pin tube 76. Again see FIG. 9.

A pair of spaced receiver tubes 72 are welded or otherwise secured in a spaced vertical alignment upon frame member 15 such that the pair of pin tubes 76 which are of a diameter smaller than the pin tube receivers 72 may be inserted therein through a generally downward motion. When such insertion is made, the gate arm mechanism 70 will be pivotally mounted with respect to the right front frame member 15. Since the structure is the exact same for the lower gate arm mechanism 70 of FIG. 11 on the opposite side of the apparatus of this invention, no further discussion is deemed necessary and the parts are similarly marked in the FIG. 11 drawing. In order to reduce weight, since gate arm 71 is intended to be removable, this arm 71, has preferably a smaller cross section then does gate arm 61.

As seen in FIG. 10 gate arm 71 is intended to rest within C-collar 77 and to be retained therein by latch 78 which is pivotally mounted to frame member 17 via pivot pin 79 in the same manner as the latch arm 50 which has been previously described.

Figure 13:
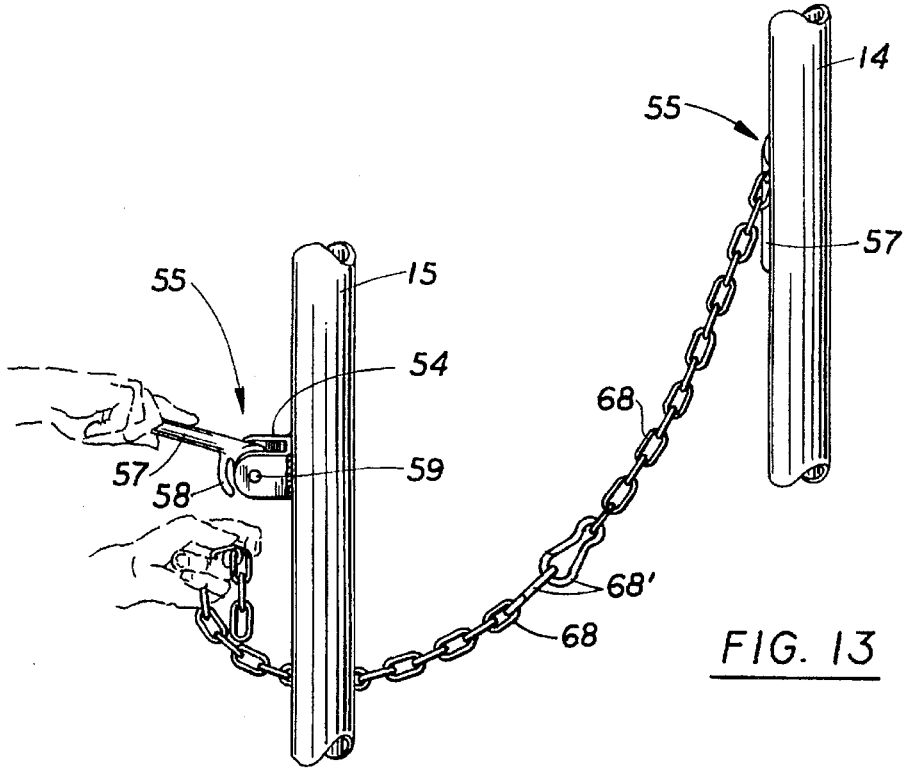
FIG. 13 is a close-up view of a portion of the left front part of the apparatus of this invention.

As seen in FIG. 1 a lower gate arm mechanism 70 is also disposed on the left side of the apparatus of this invention. In FIGS. 1, 2 and 11 there are shown the safety releases 55 mounted on the left and right frame members 14 and 15. Reference is also made to FIG. 4. In addition, a close-up of this structure 55 is shown in FIG. 13. This safety release 55 entitled cross-tie safety release includes a U-shaped bracket 54 which is welded to the right forward upright vertical member 15. As can be seen in FIG. 4 it is preferable to employ such a cross-tie safety release on each of the forward vertical frame members 14 and 15. A release arm 57 having a hook section 58 at one end and which hook section is sized to fit between the U-bracket 54 and is pivotally retained by pivot pin 59 which passes through a suitable aperture unnumbered in said hook section. A chain 68, also seen in FIG. 1, is removably mounted upon the hook section 58 such that when the release arm 57 is depending in a generally vertical position, the hook is disposed within the bracket 54. Preferably the chain is made of two chain segments connected by conventional snap hooks 68'. These snap hooks may be used by the veterinarian or the handler for attachment to the halter of the horse. The use of this chain and the need to quickly release said chain will be discussed infra. Suffice it to say, that when the arm 57 is in a 10 PM position such as in FIG. 13, the chain will become disengaged due to gravity from the hook section 58. When the reader observes FIG. 13, it will be seen that this same chain 68 while shown disengaged from the cross tie safety release of the right vertical frame member 15, is in fact engaged with the release arm of the left frame member 14.

The chain may be secured to the halter of the animal and each of its ends attached to the hook sections 58 of the release arms. Rotation of the release arms will bring the hook sections into an upward facing disposition within the U-bracket to bind the animal to the stock. Rotation in the opposite direction moves the hook sections to a down facing position such that the chain becomes disengaged from the hook sections 58 as may be desired or required in a medical emergency.

In FIG. 14, a front left perspective view is shown. Here, the rear bar 28 and its collar are not seen. The use of only a front bar 27 is also within the scope of this apparatus.

Gate arm 61 has been discussed briefly previously. This view best illustrates the presence of the spaced series of straight sided slots 47A in the gate arm. These slots 47A are placed in a generally vertical orientation and are sized in diameter to receive projecting finger 128B of arm 28 finger 45 of arm 28. See FIG. 14 which shows a projecting finger within the slot, and FIG. 15 wherein the finger is suspended in air above one such slot.

Preferably collar 129, of FIG. 15 has a throughbore 127A therein, in a manner similar to the throughbore 44B seen in FIG. 10 in collar 44, which bore will align with a specific bore 47B of the series of such spaced bores along the length of connector bar 40 spaced opposite a specific slot 47A in arm 61. Lock pin 65 shown in FIG. 11 is inserted into the vertically aligned bores 127A, 47B to secure the collar into a fixed position. The usage of the lock pin ensures a stably positioned crossbar at the desired location.

While not shown in the drawings, it is also contemplated to be within the scope of the invention to employ a front door similar in all respects to the rear door.

Stock Loading Mode

In the apparatus of this invention the animal is loaded from the rear of the what would be the right side facing the structure or left side as viewed from the rear. For purposes of this invention we shall maintain our front frame of reference to indicate that the animal is loaded from the right side. In the variant embodiment where the upper gate arm is pivotable on the left side as well as on the right side, the animal may be loaded from either side of the apparatus. The animal is led in angularly such that the head is within space 11, and the rump is pushed by the operator in a guiding motion such that the rear of the animal is moved laterally thereby aligning the animal fore and aft within space 11. Such a loading mechanism is considered safer than forcing the animal to enter from the rear of the structure as in prior art stalls or stocks. The handler is not "trapped" with the rear feet of the animal adjacent his or her body such that if the animal rears up and lunges out with it's rear feet the handler could be hurt from such animal motion. During loading, the front cross bar 27 is lowered temporarily into position to prevent the animal from exiting the space 11 during the loading process. The rear door 31 may be either open or closed during the loading process. Oftentimes it is left in the open position such that the handler can lean in or over to the animal in the attempt to guide the rear of the animal into space 11. The swing arm mechanisms are closed and secured into position. Subsequent to the confinement rear door 31 is closed and latched and the gate arms are secured into position by movement of the latches 50 and 78 per FIG. 1. The animal is then secured by the chains 68 to each of the cross tie safety releases and to the halter of the animal.

Subsequent to this attachment to the cross tie safety releases 55 the front cross bar 27 is preferably raised from its rest position, its finger placed downwardly into a gate arm 61 slot 47A and pinned into position at a suitable location in fixed arm 40 in front of the animal in order to "force" the animal rearwardly.

Once the animal is positioned within the stock, the rear gate may be opened or retained in the closed position depending upon what activity is to transpire with or on the animal. If desired, the rear cross bar 28 can be positioned at a suitable location between the two side frames across arms 61 and 40 to position the animal somewhat forward of the rear door. The rear crossbar is fixed into position by removable lock pin 46 and finger 128B being inserted into specific apertures adapted to receive them within arms 40 and 61, respectively.

It is seen that I have provided an easy entrance stock suitable for animals both big and small. This stock also permits the confinement space to be reduced to permit the animal little slack if the procedure mandates such. By not incorporating a front upper bar between vertical members 14 and 15. I reduce the possibility of injury to animals such as a horse should it decide to rear up during confinement.

I have also provided for the immediate release of the animal from its attachment to the stock due to the nature of the improved cross tie safety releases that form a part of this invention.

From a manufacturing point of view, most if not all tubular components can be made of heavy gauge aluminum, or steel. Polycarbonate plastic if prevented from UV aging may also be suitable. Other flat and flange components can be made of the same materials or galvanized iron. Metal to metal connections are best achieved as at corners for example by welding, brazing or adhesing. Suitable flooring includes tongue and groove wood sections or marine plywood.

While for the most part, I have talked of round tubular members, it is to be seen that square tubing may be similarly employed in this invention. The use of solid stock though acceptable would most likely not be desirable as it would add excessive weight to the apparatus.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A portable stock formed from a plurality of components assembled together, which stock comprises:

(a) a pair of spaced opposed side frames, wherein each side frame comprises spaced front and rear vertical members connected by a horizontal top member, each side frame having at least one intermediate member pivotally attached thereto;

(b) a pair of top cross members positioned in a spaced relationship and fixedly extending transversely between said side frames, one at a rear end thereof, and one forwardly of a middle of said side frames;

(c) front and rear bottom cross members transversely connecting said opposed side frames at the bottoms thereof;

(d) a front crossbar having a collar at one end, slidingly and pivotally mounted along a first of said side frames' intermediate member and removably secured to the second of said side frames' intermediate member;

(e) rear closure means pivotally mounted to said rear vertical member of one of said side frames;

all of which taken together define a space for the confinement of an animal;

wherein at least one of the two side frames includes as its intermediate member, at least one gate arm pivotally mounted at one end and removably securable at the other end, to permit side entry of an animal into the stock.

2. In the apparatus of claim 1 wherein the manner to removably secure said front crossbar to the first of said side frames is the provision of a series of spaced linearly aligned bores in said first of said side frames, and at least one bore is positioned through the collar of said front crossbar, and a lock pin positionable simultaneously in one bore of said side frame and said bore in the said collar of said slidingly moveable crossbar.

3. In the apparatus of claim 1 wherein a rear crossbar is slidingly and pivotally mounted to one of said side frames and removably securable to the other side frame, and which rear crossbar comprises:

a tubular member having a collar transversely mounted thereto at one end, with said collar encircling a portion of one side frame, and having a forwardly extending finger on the other end, said finger adapted to engage one of a series of slots on the other side frame.

4. In the apparatus of claim 1 wherein the vertical front and rear members of the each of said side frames are connected at their bottoms by a bottom member.

5. In the apparatus of claim 4 wherein a subfloor is overlaid between the two bottom members of the two side frames.

6. In the apparatus of claim 5 further including a floor overlaid on said subfloor.

7. In the apparatus of claim 1 wherein the rear closure is a rear door hingedly mounted to one side frame, and latchable to the other side frame.

8. In the apparatus of claim 1 wherein each side frame comprises said spaced front and rear vertical members connected by a horizontal top member and wherein both of the two side frames include said at least one gate arm pivotally mounted at one end to one of said vertical members and removably securable at the other end to the other of said vertical members.

9. In the apparatus of claim 8 wherein of said side frames includes a pair of pivotally mounted gate arms, an upper gate arm fixedly and pivotally mounted, and a lower gate arm removably and pivotally mounted.

10. In the apparatus of claim 1, wherein one of said side frames includes an intermediate fixedly secured connector bar between the front and rear vertical members.

11. In the apparatus of claim 8 wherein one of said side frames includes a pair of pivotally mounted gate arms, an upper gate arm fixedly and pivotally mounted, and a lower gate arm removably and pivotally mounted.

12. In the apparatus of claim 1 further including a cross tie safety release mounted on each of the front vertical members.

13. In the apparatus of claim 12, wherein the cross tie safety release comprises a U-bracket and a release arm with a hook section at one end, which hook section is sized to fit between the U-bracket and which is pivotally retained by a pivot pin therein.

14. In the apparatus of claim 1 wherein the other of said side frames includes both an intermediate fixedly secured connector bar between the front and rear vertical members and also includes a lower pivotally mounted gate arm therebeneath.

15. A portable stock formed from a plurality of components assembled together, which stock comprises:

(a) a pair of spaced opposed side frames, wherein each side frame comprises spaced front and rear vertical members connected by a horizontal top member and having at least one intermediate member pivotally attached thereto;

(b) a pair of top cross members positioned in a spaced relationship both of which fixedly extend transversely between said side frames, one at a rear end thereof, and one forwardly of a middle of said side frames;

(c) front and rear bottom cross members transversely connecting said opposed side frames at the bottoms thereof;

(d) a rear crossbar slidingly and pivotally mounted along one of said side frames' intermediate member and removably secured to the other of said side frame's intermediate member;

(e) a bottom member connecting each side frame's vertical front and rear members;

wherein one of said side frames includes as its intermediate member a pair of pivotally mounted gate arms, an upper gate arm fixedly and pivotally mounted, and a lower gate arm attached thereto removably and pivotally mounted;

and wherein one of said side frames includes an intermediate fixedly secured connector bar between the respective front and rear vertical members;

all of which taken together define a space for the confinement of an animal.

16. The apparatus of claim 1 wherein the pivotally mounted gate arms are retained in position by a retention means comprised of:

(a) a C collar mounted on the side frame vertical member opposite the pivot mounting of the gate arm, into which C collar the gate arm may be disposed, and b) a pivotally mounted latch mounted adjacent to said collar and adapted to cooperate therewith to retain said gate arm.

17. In the apparatus of claim 15 wherein the side frame which includes the intermediate fixedly secured connector bar between the front and rear vertical members also includes a lower pivotally mounted gate arm therebeneath.

18. In the apparatus of claim 15 wherein each bottom member of the side frames includes an inwardly directed inverted L-flange along the length thereof for receipt of a subfloor.

19. In the apparatus of claim 18 wherein the subfloor is disposed upon L-flanges of the side frame bottom members, and a traction mat is positioned upon the subfloor.

20. In the apparatus of claim 15 wherein a series of spaced slots are provided in one side frame, and in addition to the rear crossbar, a front crossbar is slidably and pivotally mounted to one of said side frames, each of said crossbars is spaced from the other and each of which comprises:

a tubular member having a collar transversely mounted thereto at one end, with said collar encircling a portion of one of said side frames, and having a forwardly extending finger on the other end, said finger adapted to engage one of a series of slots on the opposite side frame.

21. In the apparatus of claim 20 wherein both of the front and rear crossbars are sliding attached to the same side frame intermediate member.

22. In the apparatus of claim 20 wherein at least one of said crossbars comprises:

a tubular elongated member having a circular collar disposed at one end of said elongated member, said elongated member also having at the other end, a forwardly projecting upwardly extending finger member extending outward therefrom.

23. A portable stock formed from a plurality of components assembled together, which stock comprises:

(a) a pair of spaced opposed side frames, wherein each side frame comprises spaced front and rear vertical members connected by a horizontal top member and having at least one intermediate member pivotally attached thereto;

(b) a pair of top cross members positioned in a spaced relationship and fixedly extending transversely between said side frames, one at a rear end thereof, and one forwardly of a middle of said side frames;

(c) front and rear bottom cross members transversely connecting said opposed side frames at the bottoms thereof;

(d) front and rear crossbars, each slidingly and pivotally mounted to one of said side frames' intermediate member and removably securable to the other of said side frame's intermediate member;

wherein one of said side frames includes as its intermediate member a pair of pivotally mounted gate arms, an upper gate arm fixedly and pivotally mounted, and a lower gate arm removably and pivotally mounted;

and wherein one of said side frames includes at least one intermediate fixedly secured connector bar between the front and rear vertical members;

all of which taken together define a space for the confinement of an animal.

24. In the apparatus of claim 23 wherein the upper gate arm includes a series of spaced dovetail slots for receipt of a projecting finger disposed at one end of a crossbar.

25. In the apparatus of claim 22 wherein the other end of said elongated member is closed off by a cap from which extends the projecting finger.

26. In the apparatus of claim 23 wherein both of the front and rear crossbars are slidably attached to the same side frame upper gate arm.

27. In the apparatus of claim 23 further including bottom frame members connecting each side frame's vertical front and rear members.

28. In the apparatus of claim 27 wherein a subfloor is overlaid between the two bottom members of the two side frames.

29. In the apparatus of claim 28 further including a non-slip surface overlaid on said subfloor.

30. A portable stock formed from a plurality of components assembled together, which stock comprises:

(a) a pair of spaced opposed side frames, wherein each side frame comprises spaced front and rear vertical members connected by a horizontal top member and having at least one intermediate member pivotally attached thereto;

(b) a pair of top cross members positioned in a spaced relationship and both fixedly extending transversely between said side frames, one at a rear end thereof, and one forwardly of the middle of said side frames;

(c) front and rear bottom cross members transversely connecting said opposed side frames at the bottoms thereof;

(d) a rear crossbar slidingly and pivotally mounted to one of said side frames' intermediate member and removably securable to the other of said side frames' intermediate member;

(e) a front crossbar spaced forward of said rear crossbar and similarly mounted as said rear crossbar;

(f) bottom frame members connecting each of said side frame's front and rear vertical members at the bottom thereof;

all of which taken together define a space for the confinement of an animal;

wherein both of the two side frames includes as its intermediate member, at least one gate arm pivotally mounted at one end and removably securable at the other end, to permit side entry of an animal into the stock.

* * * * *